US010544493B2

(12) United States Patent
Misra et al.

(10) Patent No.: US 10,544,493 B2
(45) Date of Patent: Jan. 28, 2020

(54) ALUMINUM ALLOYS WITH HIGH STRENGTH AND COSMETIC APPEAL

(71) Applicant: Apple Inc., Cupertino, CA (US)

(72) Inventors: Abhijeet Misra, Mountain View, CA (US); James A. Wright, Los Gatos, CA (US); Herng-Jeng Jou, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/244,750

(22) Filed: Jan. 10, 2019

(65) Prior Publication Data

US 2019/0211432 A1 Jul. 11, 2019

Related U.S. Application Data

(63) Continuation of application No. 15/406,153, filed on Jan. 13, 2017, now Pat. No. 10,208,371.

(60) Provisional application No. 62/361,675, filed on Jul. 13, 2016.

(51) Int. Cl.

| | |
|---|---|
| ***C22F 1/053*** | (2006.01) |
| ***C22C 1/02*** | (2006.01) |
| ***C22C 21/10*** | (2006.01) |

(52) U.S. Cl.

CPC ..... *C22F 1/053* (2013.01); *C22C 1/02* (2013.01); *C22C 1/026* (2013.01); *C22C 21/10* (2013.01)

(58) Field of Classification Search

CPC . C22F 1/053; C22C 1/02; C22C 1/026; C22C 21/10

See application file for complete search history.

(56) References Cited

U.S. PATENT DOCUMENTS

| | | | |
|---|---|---|---|
| 2,706,680 | A | 4/1955 | Criner |
| 9,194,029 | B2 | 11/2015 | Takemura |
| 10,208,371 | B2 | 2/2019 | Misra et al. |
| 2005/0238528 | A1 | 10/2005 | Lin et al. |
| 2006/0169371 | A1 | 8/2006 | Cosse et al. |
| 2006/0289093 | A1 | 12/2006 | Yan et al. |
| 2008/0066833 | A1 | 3/2008 | Lin et al. |
| 2008/0145266 | A1 | 6/2008 | Chen et al. |
| 2008/0173377 | A1 | 6/2008 | Khosla et al. |
| 2008/0299000 | A1 | 12/2008 | Gheorghe et al. |
| 2010/0101748 | A1 | 4/2010 | Hata et al. |
| 2012/0111459 | A1 | 5/2012 | Takemura |
| 2013/0199680 | A1 | 8/2013 | Apelian et al. |
| 2013/0213533 | A1 | 8/2013 | Shikama et al. |
| 2013/0284322 | A1 | 10/2013 | Gasqueres et al. |
| 2014/0366997 | A1 | 12/2014 | Kamat et al. |

(Continued)

FOREIGN PATENT DOCUMENTS

| | | |
|---|---|---|
| CN | 104762538 | 7/2015 |
| CN | 105492640 | 4/2016 |

(Continued)

OTHER PUBLICATIONS

K T Kashyap, "Effect of zirconium addition on the recrystallization behaviour of a commercial Al—Cu—Mg alloy," *Bull. Mater. Sci.*, 2001, vol. 24, No. 6, pp. 643-648.

(Continued)

*Primary Examiner* — Cam N. Nguyen
(74) *Attorney, Agent, or Firm* — Polsinelli PC

(57) ABSTRACT

The disclosure provides aluminum alloys having varying ranges of alloying elements and properties. The aluminum alloys have a wt % ratio of Zn to Mg from 2.5 to 3.5.

19 Claims, 5 Drawing Sheets

(56) References Cited

U.S. PATENT DOCUMENTS

| | | | |
|---|---|---|---|
| 2015/0069770 | A1 | 3/2015 | Hashimoto et al. |
| 2015/0069772 | A1 | 3/2015 | Hashimoto et al. |
| 2015/0090373 | A1 | 4/2015 | Gable et al. |
| 2015/0218677 | A1 | 8/2015 | Aruga et al. |
| 2015/0218679 | A1 | 8/2015 | Aruga et al. |
| 2015/0315680 | A1 | 11/2015 | Yan et al. |
| 2015/0354045 | A1 | 12/2015 | Gable et al. |
| 2015/0368772 | A1 | 12/2015 | Jou et al. |
| 2015/0376742 | A1 | 12/2015 | Matsumoto et al. |
| 2019/0169717 | A1 | 6/2019 | Li et al. |

FOREIGN PATENT DOCUMENTS

| | | |
|---|---|---|
| CN | 105671384 | 6/2016 |
| GB | 1154013 | 6/1969 |
| JP | 60-234955 | 11/1985 |
| JP | H-03-294445 | 12/1991 |
| JP | 2010-159489 | 7/2010 |
| JP | 2012-246555 | 12/2012 |
| JP | 2013-007086 | 1/2013 |
| JP | 2015-140460 | 8/2015 |
| WO | WO 2006/127811 | 11/2006 |
| WO | WO 2009/024601 | 2/2009 |
| WO | WO 2011/155609 | 12/2011 |
| WO | WO 2012/080592 | 6/2012 |

OTHER PUBLICATIONS

Weiland et al., "The Role of Zirconium Additions in Recrystallization of Aluminum Alloys," *Materials Science Forum*, 2007, vols. 558-559, pp. 383-387.

Adachi et al., "Effect of Zr Addition on Dynamic Recrystallization during Hot Extrusion in Al Alloys," *Materials Transactions*, vol. 46, No. 2 (2005), pp. 211-214.

Shikama et al., "Highly SCC Resistant 7000-series Aluminum Alloy Extrusion," *Kobelco Technology Review No.* 35, Jun. 2017, pp. 65-68.

Kundar et al., "Impact toughness of ternary Al—Zn—Mg alloys in as cast and homogenized condition measured in the temperature range 263-673 K," *Bull. Mater. Sci.*, 2000, vol. 23, No. 1, pp. 35-37.

John A. Taylor, "The effect of iron in Al—Si casting alloys," Conference Paper, Oct. 2004, Cooperative Research Centre for Cast Metals Manufacturing (CAST), The University of Queensland, Brisbane, Australia, 11 pages.

Yuan et al., "Effect of Zr addition on properties of Al—Mg—Si aluminum alloy used for all aluminum alloy conductor," Materials and Design 32 (2011), pp. 4195-4200.

P. Spiekermann, "Alloys—a special problem of patent law?" Nonpublished English Translation of Document, Dec. 31, 2002, 20 pages.

ALUMINUM ALLOYS WITH HIGH STRENGTH AND COSMETIC APPEAL

CROSS-REFERENCE TO RELATED PATENT APPLICATIONS

This application is a continuation of U.S. patent application Ser. No. 15/406,153, entitled "Aluminum Alloys with High Strength and Cosmetic Appeal," filed on Jan. 13, 2017, now U.S. Pat. No. 10,208,371, which claims the benefit under 35 U.S.C. § 119(e) of U.S. Patent Application No. 62/361,675, entitled "Aluminum Alloys with High Strength and Cosmetic Appeal," filed on Jul. 13, 2016. The content of each application is incorporated herein by reference in its entirety.

TECHNICAL FIELD

Embodiments described herein generally relate to aluminum alloys with high strength and cosmetic appeal for applications including enclosures for electronic devices.

BACKGROUND

Commercial aluminum alloys, such as the 6063 aluminum (Al) alloy, have been used for fabricating enclosures for electronic devices. However, the 6063 aluminum alloy has relatively low yield strength, for example, about 214 MPa, which may dent easily when used as an enclosure for electronic devices. It may be desirable to produce aluminum alloys with high yield strength such that the alloys do not dent easily. The electronic devices may include mobile phones, tablet computers, notebook computers, instrument windows, appliance screens, and the like.

Many commercial 7000 series aluminum alloys have been developed for aerospace applications. Generally, 7000 series aluminum alloys have high yield strengths. However, commercial 7000 series aluminum alloys are not cosmetically appealing when used to make enclosures for electronic devices.

There still remains a need to develop aluminum alloys with high strength and improved cosmetics.

SUMMARY

Additional embodiments and features are set forth in part in the description that follows, and in part will become apparent to those skilled in the art upon examination of the specification, or may be learned by the practice of the embodiments discussed herein. A further understanding of the nature and advantages of certain embodiments may be realized by reference to the remaining portions of the specification and the drawings, which forms a part of this disclosure.

In one aspect, the disclosure is directed to an aluminum alloy comprising 3.4 to 4.9 wt % Zn 1.3 to 2.1 wt % Mg, no greater than 0.06 wt % Cu, no greater than 0.06 wt % Zr, no greater than 0.08 wt % Fe, no greater than 0.05 wt % Si, no greater than 0.02 wt % Mn, no greater than 0.02 wt % Cr, Ti, Ga, Sn, no greater than 0.03 wt % total of Mn and Cr, no greater than 0.02 wt % of any one additional element, and no greater than 0.10 wt % total of additional elements, with the balance being aluminum and incidental impurities.

In another aspect, the aluminum alloy has a wt % ratio of Zn to Mg from 1.8-3.5 wt %.

In another aspect, the aluminum alloy has 4.7-4.9 wt % Zn and 1.75-1.85 wt % Mg. In another aspect, the alloy has 4.3-4.5 wt % Zn and 1.45-1.55 wt % Mg. In another aspect, the alloy has 3.9-4.1 wt % Zn and 1.55-1.65 wt % Mg. In another aspect, the alloy has 4.3-4.5 wt % Zn and 1.35-1.45 wt % Mg. In another aspect, the alloy has 3.5-3.7 wt % Zn and 1.95-2.05 wt % Mg. In another aspect, the alloy has 4.2-4.4 wt % Zn and 1.85-1.95 wt % Mg.

In another aspect, the alloy has 0.03-0.06 wt % Zr. In another aspect, the alloy has 0.04-0.05 wt % Zr. In another aspect, the alloy has 0.01 wt % Zr.

In another aspect, the alloy has 0.025-0.06 wt % Cu. In another aspect, the alloy has 0.04-0.05 wt % Cu.

In another aspect, the alloy has alloy comprises 0.06 wt %-0.08 wt % Fe. In another aspect, the alloy has 0 and 0.01 wt % Fe.

In another aspect, the alloy has 0-0.01 wt % Cr and 0.01 wt % Mn.

In another aspect, the stress corrosion cracking of the alloy is greater than 12 days to failure measured according to G30/G44 ASTM standards. In another aspect, stress corrosion cracking of the alloy is greater than 18 days to failure measured according to G30/G44 ASTM standards.

In another aspect, the Charpy impact energy of the alloy in the L-T orientation is greater than or equal to 11 J/cm$^2$.

In various aspects, the alloy has a yield strength of at least about 350 MPa.

BRIEF DESCRIPTION OF THE DRAWINGS

Further non-limiting aspects of the disclosure are described by reference to the drawings and descriptions.

DETAILED DESCRIPTION

Figure 1:
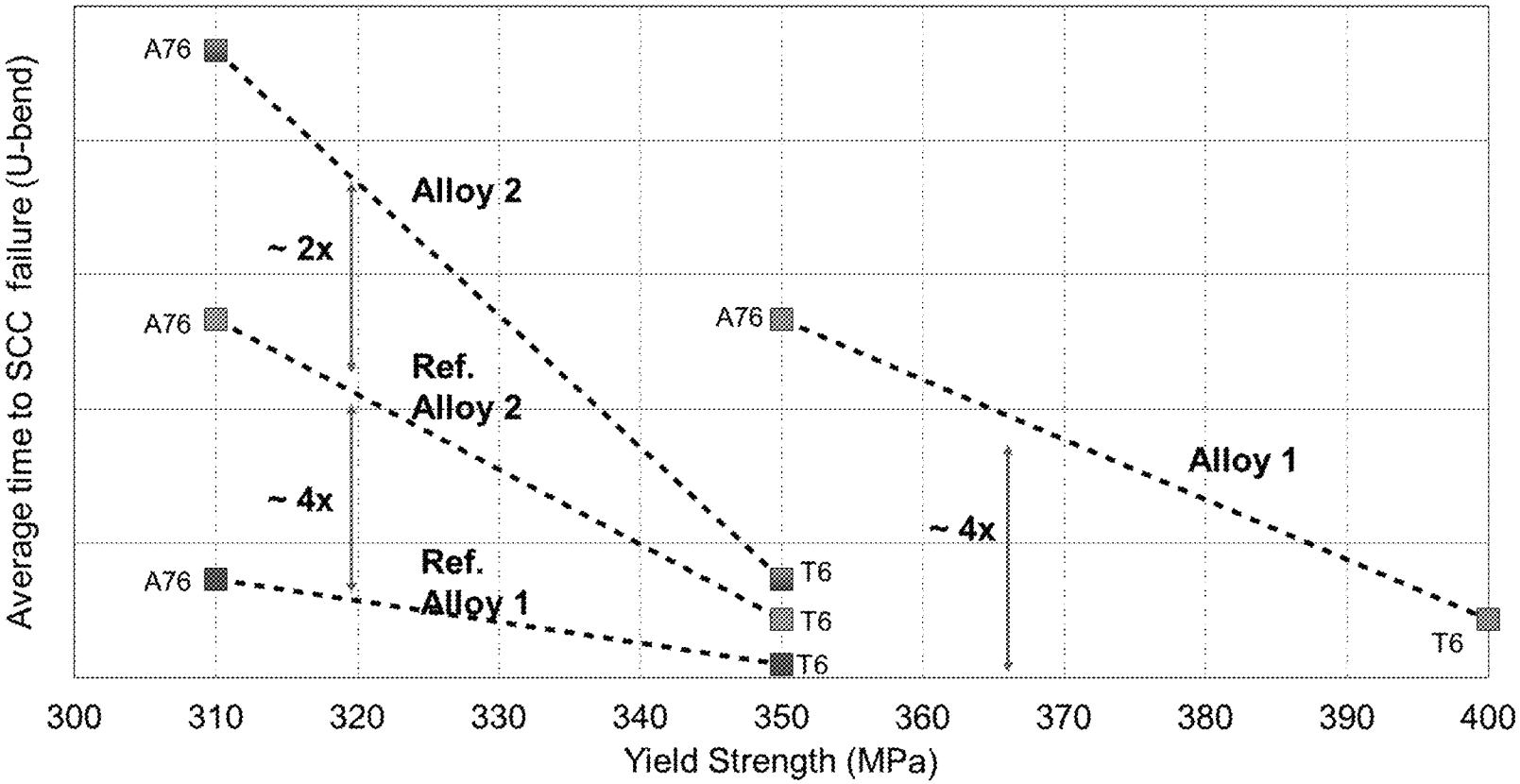
FIG. 1 depicts a plot of yield strength vs. average time to stress corrosion cracking (SCC) failure for certain representative alloys.

The disclosure may be understood by reference to the following detailed description, taken in conjunction with the drawings as described below. It is noted that, for purposes of illustrative clarity, certain elements in various drawings may not be drawn to scale, may be represented schematically or conceptually, or otherwise may not correspond exactly to certain physical configurations of embodiments.

The disclosure provides for 7xxx series aluminum alloys that have improved abilities over known alloys. In various aspects, the alloys disclosed herein can meet one or more properties and/or processing variables simultaneously. These properties can include reduction of SCC resistance as a function of yield strength, higher Scheil and/or lower solvus temperatures (within working tolerances of extrusion pressure), improved ductility, and the ability to anodize using only sulfuric acid. The improved properties do not result in substantial reductions in yield strength.

In various aspects, the Al alloys described herein can provide faster processing parameters than conventional 7xxx series Al alloys, while maintaining properties such as color, hardness, and/or strength. In some aspects, having a high extrusion productivity and low-quench sensitivity can allow for reduction in Zr grain refinement, reducing or eliminating the need for a subsequent heat treatment.

In further various aspects, the alloy has a tensile yield strength not less than 300 MPa, while also having extrusion speeds and/or neutral colors as described herein.

The Al alloys can be described by various wt % of elements, as well as specific properties. In all descriptions of the alloys described herein, it will be understood that the wt % balance of alloys is Al and incidental impurities. In various embodiments, an incidental impurity can be no greater than 0.05 wt % of any one additional element (i.e., a single impurity), and no greater than 0.10 wt % total of all additional elements (i.e., total impurities).

In some aspects, an alloy composition can include a small amount of incidental impurities. The impurity elements can be can be present, for example, as a byproduct of processing and manufacturing.

Zinc and Magnesium Precipitate

The alloys can be strengthened by solid solution. Zn and Mg may be soluble in the alloys. Solid solution strengthening can improve the strength of a pure metal. In this alloying technique, atoms of one element, e.g. an alloying element, may be added to the crystalline lattice of another element, e.g. a base metal. The alloying element can be contained with the matrix, forming a solid solution.

Zn and Mg precipitate as $Mg_xZn_y$ (e.g., $MgZn_2$) to form a second $Mg_xZn_y$ phase in the alloy. This second $Mg_xZn_y$ phase can increase the strength of the alloy by precipitation strengthening. In various aspects, $Mg_xZn_y$ precipitates can be produced from processes including rapid quenching and subsequent heat treatment, as described herein.

In various aspects, the Zn/Mg wt % ratio is from 1.7-3.2. In some variations, the Zn/Mg wt % ratio is from 1.7-3.0. In some variations, the Zn/Mg wt % ratio is from 2.5-3.2.

$Mg_xZn_y$ (e.g., $MgZn_2$) particles or precipitates can be formed and distributed in the Al. In some aspects, the alloys can have a Zn:Mg wt % ratio from 1.7-3.2. In some aspects, the Zn/Mg wt % ratio is from 2.0 to 3.5. In some aspects, the Zn/Mg wt % ratio is from 2.5 to 3.5. In some aspects, the Zn/Mg wt % ratio is from 2.0 to 3.2. In some aspects, the Zn/Mg wt % ratio is from 2.5 to 3.0. In some embodiments, the alloys can have Zn to Mg (Zn/Mg) weight ratio of $2.5<Zn:Mg<3.2$. In various aspects, the alloys have improved stress corrosion cracking resistance.

Without being limited to a particular mechanism of action, varying or changing the ratio of Zn:Mg in the alloy can strengthen the alloy and/or reduce SCC resistance. The amount of Zn and Mg in the alloy can be selected at stoichiometric amounts such that all available Mg and Zn are used to form $Mg_xZn_y$ in the alloy. In some embodiments, the Zn and Mg is in a molar ratio such that some, or alternatively no, excess Mg or Zn is present outside of $Mg_xZn_y$. Without wishing to be held to a particular mechanism or mode of action, reducing free Zn in the aluminum alloy matrix can reduce undesired cosmetic properties such as blotchiness in the alloy. Further, reducing free Zn can reduce delamination of the anodized layer. Alternatively, in various embodiments, some excess Zn or Mg may be present.

In some variations, the alloy has 3.4-4.9 wt % Zn. In some variations, the alloy has equal to or greater than 3.4 wt % Zn. In some variations, the alloy has equal to or greater than 3.4 wt % Zn. In some variations, the alloy has equal to or greater than 3.6 wt % Zn. In some variations, the alloy has equal to or greater than 3.8 wt % Zn. In some variations, the alloy has equal to or greater than 4.0 wt % Zn. In some variations, the alloy has equal to or greater than 4.2 wt % Zn. In some variations, the alloy has equal to or greater than 4.4 wt % Zn.

In some variations, the alloy has equal to or greater than 4.6 wt % Zn. In some variations, the alloy has less than or equal to than 4.9 wt % Zn. In some variations, the alloy has less than or equal to than 4.7 wt % Zn. In some variations, the alloy has less than or equal to than 4.5 wt % Zn. In some variations, the alloy has less than or equal to than 4.3 wt % Zn. In some variations, the alloy has less than or equal to than 4.1 wt % Zn. In some variations, the alloy has less than or equal to than 3.9 wt % Zn. In some variations, the alloy has less than or equal to than 3.7 wt % Zn. In some variations, the alloy has less than or equal to than 3.5 wt % Zn.

In some variations, the alloy has equal to or greater than 1.3 wt % Mg. In some variations, the alloy has equal to or greater than 1.5 wt % Mg. In some variations, the alloy has equal to or greater than 1.7 wt % Mg. In some variations, the alloy has less than or equal to 2.1 wt % Mg. In some variations, the alloy has less than or equal to 1.9 wt % Mg. In some variations, the alloy has less than or equal to 1.7 wt % Mg. In some variations, the alloy has less than or equal to 1.5 wt % Mg. In some variations, the alloy has from 1.3 to 2.1 wt % Mg.

In certain variations, the alloy has from 4.7-4.9 wt % Zn and 1.75-1.85 wt % Mg.

In certain variations, the alloy has from 4.3-4.5 wt % Zn and 1.45-1.65 wt % Mg.

In certain variations, the alloy has from 3.9-4.1 wt % Zn and from 1.55-1.65 wt % Mg.

In certain variations, the alloy has from 4.3-4.5 wt % Zn and from 1.35-1.45 wt % Mg.

In certain variations, the alloy has from 3.5-3.7 wt % Zn and from 1.95-2.05 wt % Mg.

In certain variations, the alloy has from 3.5-3.7 wt % Zn and from 1.95-2.05 wt % Mg.

In certain variations, the alloy has from 4.2-4.4 wt % Zn and from 1.85-1.95 wt % Mg.

In certain variations, the alloy has from 4.2-4.4 wt % Zn and 1.85-1.95 wt % Mg.

In some variations, the alloy has 3.4-4.9 wt % Zn, 1.3-2.1 wt % Mg, no greater than 0.05 wt % Cu, no greater than 0.06 wt % Zr, no greater than 0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any single additional element not recited above (i.e., a single impurity), and no greater than 0.10 wt % total of all additional elements not described above (i.e., total impurities), with the balance being aluminum.

In one variation, the alloy has from 4.7-4.9 wt % Zn, 1.75-1.85 wt % Mg, 0.025-0.06 wt % Cu, 0.03-0.06 wt % Zr, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any single additional element not recited above (i.e., a single impurity), and no greater than 0.10 wt % total of all additional elements not described above (i.e., total impurities), with the balance being aluminum. In some further variations, the alloy has 0.04-0.05 wt % Cu and/or 0.04-0.05 wt % Zr. For example, Alloy 1 as described herein has 4.8 wt % Zn, 1.8 wt % Mg, 0.05 wt % Cu, 0.05 wt % Zr, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum. In another example, Alloy 9 as described herein has 4.8 wt % Zn, 1.8 wt % Mg, 0.04 wt % Cu, 0.04 wt % Zr, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum.

In another variation, the alloy has from 4.3-4.5 wt % Zn, 1.45-1.75 wt % Mg, 0.025-0.06 wt % Cu, 0.03-0.06 wt % Zr, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum. In some further variations, the alloy has from 1.45-1.55 wt % Mg. In some further variations, the alloy has from 1.55-1.65 wt % Mg. In some further variations, the alloy has 0.04-0.05 wt % Cu and/or 0.04-0.05 wt % Zr. In some further variations, the alloy has 0.03-0.05 wt % Cu and/or 0.03-0.05 wt % Zr. In some further variations, the alloy has 0.05-0.06 wt % Cu and/or 0.05-0.06 wt % Zr. For example, Alloy 2 as described herein has 4.4 wt % Zn, 1.6 wt % Mg, 0.05 wt % Cu, 0.05 wt % Zr, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum. In another example, Alloy 10 as described herein has 4.4 wt % Zn, 1.5 wt % Mg, 0.04 wt % Cu, 0.04 wt % Zr, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum.

In one variation, the alloy has from 3.9-4.1 wt % Zn, 1.55-1.65 wt % Mg, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum. For example, Alloy 3 as described herein has 4.0 wt % Zn, 1.6 wt % Mg, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum.

In one variation, the alloy has from 4.3-4.5 wt % Zn, 1.35-1.45 wt % Mg, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum. For example, Alloy 4 as described herein has 4.4 wt % Zn, 1.4 wt % Mg, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum.

In some variations, the alloy has from 3.5-3.7 wt % Zn, 1.95-2.05 wt % Mg, optionally 0.025-0.06 wt % Cu, optionally 0.03-0.06 wt % Zr, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any single additional element not recited above (i.e., a single impurity), and no greater than 0.10 wt % total of all additional elements not described above (i.e., total impurities), with the balance being aluminum. In some further variations, the alloy has 0.04-0.05 wt % Cu and/or 0.04-0.05 wt % Zr.

In one variation, the alloy has from 3.5-3.7 wt % Zn, 1.95-2.05 wt % Mg, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any single additional element not recited above (i.e., a single impurity), and no greater than 0.10 wt % total of all additional elements not described above (i.e., total impurities), with the balance being aluminum. For example, Alloy 5 as described herein has 3.6 wt % Zn, 2.0 wt % Mg, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum.

In one variation, the alloy has from 3.5-3.7 wt % Zn, 1.95-2.05 wt % Mg, 0.025-0.06 wt % Cu, 0.03-0.06 wt % Zr, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum. In some further variations, the alloy has 0.04-0.05 wt % Cu and/or 0.04-0.05 wt % Zr. For example, Alloy 6 as described herein has 3.6 wt % Zn, 2.0 wt % Mg, 0.05 wt % Cu, 0.05 wt % Zr, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum.

In some variations, the alloy has from 4.2-4.4 wt % Zn, 1.85-1.95 wt % Mg, optionally 0.025-0.06 wt % Cu, optionally 0.03-0.06 wt % Zr, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any single additional element not recited above (i.e., a single impurity), and no greater than 0.10 wt % total of all additional elements not described above (i.e., total impurities), with the balance being aluminum.

In one variation, the alloy has from 4.2-4.4 wt % Zn, 1.85-1.95 wt % Mg, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum. For example, Alloy 7 as described herein has 4.3 wt % Zn, 1.9 wt % Mg, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum.

In one variation, the alloy has from 4.2-4.4 wt % Zn, 1.85-1.95 wt % Mg, 0.025-0.06 wt % Cu, 0.03-0.06 wt % Zr, 0.06-0.08 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum. In some further variations, the alloy has 0.04-0.05 wt % Cu and/or 0.04-0.05 wt % Zr. For example, Alloy 8 as described herein has 4.3 wt % Zn, 1.9 wt % Mg, 0.05 wt % Cu, 0.05 wt % Zr, 0.07 wt % Fe, no greater than 0.05 wt % Si, no greater than 0.02 wt % Mn, no greater than 0.02 wt % Cr, no greater than 0.02 wt % Ti, no greater than 0.02 wt % Ga, no greater than 0.02 wt % Sn, no greater than 0.03 wt % total of Mn and Cr, no greater than 0.02 wt % of any additional element not recited above (i.e., a single impurity), and no greater than 0.10 wt % total of all additional elements not described above (i.e., total impurities), with the balance being aluminum.

Stress Corrosion Cracking Resistance

The alloys disclosed herein can have increased time to stress corrosion cracking (SCC) as compared to other aluminum alloys. In conventional aluminum alloys, yield strength and time to SCC failure are inversely related. Alloys with higher yield strength tend to have shorter time to SCC failure, and vice versa. Alloys disclosed herein have increased time to SCC failure without a substantial reduction in properties such as yield strength.

Stress corrosion tests may be performed on the alloys via ASTMG30/G44, which covers the test method of sampling, type of specimen, specimen preparation, test environment, and method of exposure for determining the susceptibility to SCC of aluminum alloys.

Reference Alloys 1 and 2 are representative alloys of PCT/US2014/058427 to Gable et al., published as WO 2015/048788, and incorporated herein by reference in its entirety. The alloys disclosed herein have higher SCC resistance than Reference Alloys 1 and 2. In various aspects, the alloys described herein are more resistant to corrosion than Reference Alloys 1 and 2, as evidenced by reduced corrosion current density and increased threshold passivity. In some aspects, the alloys can have a higher ductility than Reference Alloys 1 and 2, as measured by percent elongation (% EI) and percent reduction in area (% RA). In some aspects, the alloys can have a higher toughness than Reference Alloys 1 and 2, as measured by Charpy Impact Energy. In various aspects, properties such as yield strength, extrudability (including Scheil and Solvus temperatures), hardness, extrusion pressure, Charpy impact energy, and/or ultimate tensile strength, among other properties, are not substantially reduced as compared to Reference Alloys 1 and 2, as further described herein.

In some variations, the alloys described herein have at least 1.5× time to SCC failure as compared to Representative Alloys 1 and 2.

FIG. 1 depicts a comparison of the yield strength and average time to SCC failure for representative alloys. Alloys were tested from two different temper conditions: T6 and A76. The different temper conditions result in inversely related average time to SCC failure and yield strength. T6 refers to peak aging heat treatment to an alloy, such that the alloy has the greatest strength. Specifically, the T6 treatment includes water quenching following extrusion and aging by a two-step heat treatment including heated at 100° C. for 5 hours followed by heated at 150° C. for 15 hours. A76 refers to an over-aging treatment to an alloy. The A76 treatment can increase resistance to SCC as measured by the average time to SCC failure. The A76 treatment includes force air cooling following extrusion and aging by a two-step heat treatment including heated at 100° C. for 5 hours followed by heated at 165° C. for 12 hours.

Figure 2:
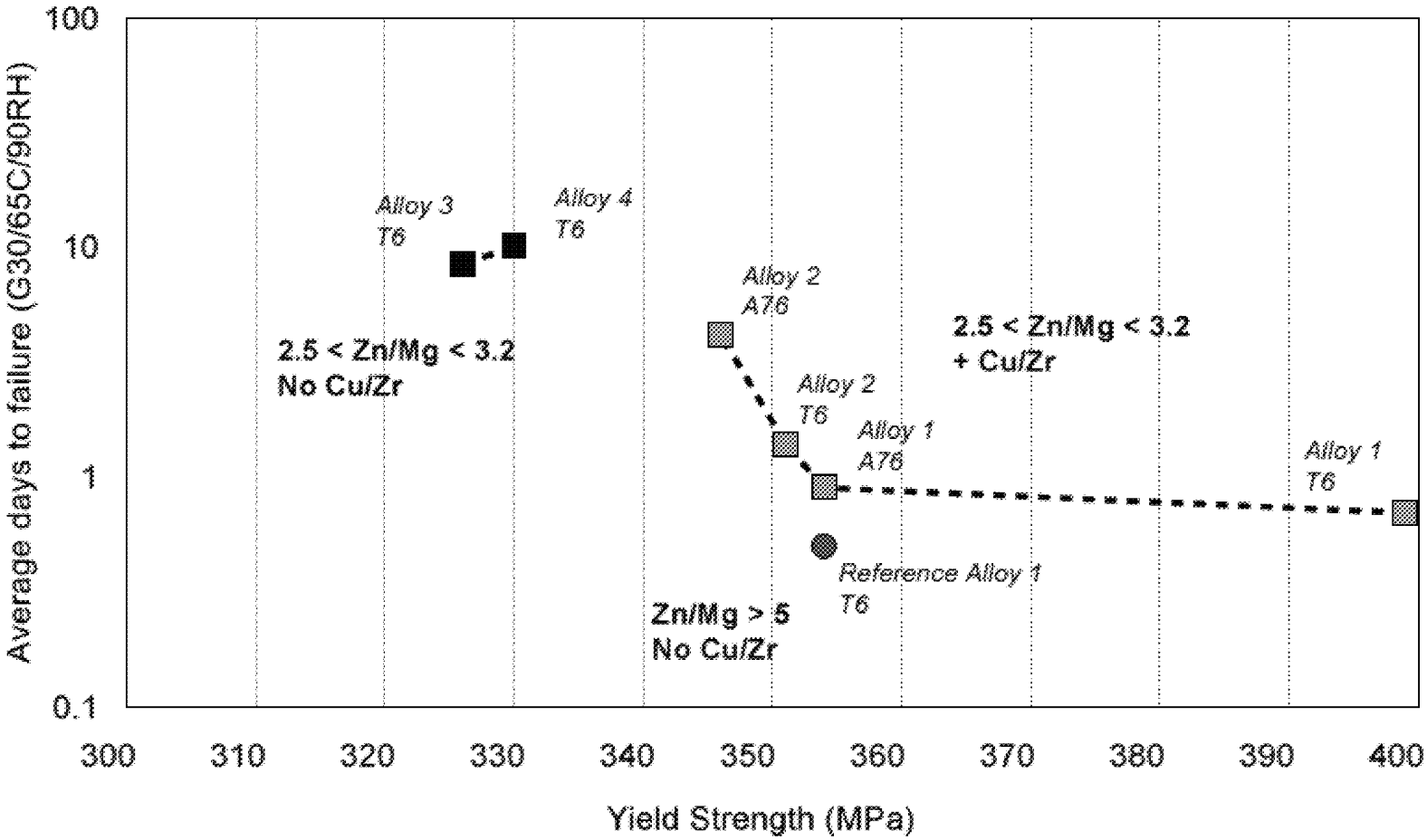
FIG. 2 depicts the average days to failure as a function of yield strength for different ratios of Zn:Mg, with and without Cu and Zr, of representative alloys.

FIG. 2 depicts the average days to failure as compared to yield strength for representative alloys at different temper conditions. The Y-axis shows the days to fail of each alloy on a logarithmic scale, while the X-axis shows yield strength. Reference Alloy 1, which has Zn:Mg>5, has lower strength, and lower days to failure as compared to all reference alloys with a lower Zn:Mg ratio. Alloy 1 and 2, in which 2.5<Zn:Mg<3.2, have a substantially increased yield strength show increased yield strength. The days to failure substantially increased without Cu or Zr, though yield strength reduced for these alloys.

The electrical conductivity of each of Alloys 1-4 was measured. As such, various properties observed for Alloys 1-4 were accomplished without any appreciable reduction in electrical conductivity (% IACS) as compared to Reference Alloy 1. In some aspects, electrical conductivity can be a proxy for thermal conductivity.

Table 1A depicts the yield strength and relative average time to failure of Alloys 1-4 compared to Reference Alloy 1 under different conditions. In each instance, the yield strength remained within the scope of Reference Alloy 1, while the SCC time to failure was substantially greater than the SCC time to failure of Reference Alloy 1 under two different ASTM Standards, ASTM G30 and ASTM G44, whether the alloy was peak aged (T6) or over-aged (A76). The alloys were tested under G30/65° C./90% RH conditions in two different instances. In each instance, the measured SCC time to failure increases by multiple days while keeping the yield strength of the alloy within 10% of Reference Alloy 1 and 2.

Reference Alloy 1 was peak aged. When Alloys 1-4 were peak aged, Alloys 1-4 showed an increased time to failure ranging from 3× to 6.7× relative to Reference Alloy 1 under G30/G44 conditions. When tested under G30/65° C./90% RH conditions, Alloy 1 had at least a 1.4× increase in days to SCC time to failure over Reference Alloy 1, however Alloys 3 and 4 showed substantial 16.8× and 20.4× increases, respectively, relative to Reference Alloy 1. While the yield strength of over-aged (A76) Alloys 1 and 2 remained within 5% of the yield strength of peak aged Reference Alloy 1, the SCC time to failure increased by greater than 3.7× under G30/G44 conditions, and by 1.8× and 8.4×, respectively, under G30/65° C./90% RH testing conditions.

TABLE 1A

| Property | Reference Alloy 1 | Alloy 1 | | Alloy 2 | | Alloy 3 | Alloy 4 |
|---|---|---|---|---|---|---|---|
| Temper Conditions | T6 | T6 | A76 | T6 | A76 | T6 | T6 |
| YS (MPa) | 1x | 1.13x | 1x | 1x | 0.95x | 0.92x | 0.93x |
| SCC G30/G44 | 1x | >3x | >3.7x | >3.7x | >3.7x | >6x | >6.7x |
| SCC G30/65° C./90% RH (Test 1) | 1x | 1.5x | >2x | >3x | >2x | | |
| SCC G30/65° C./90% RH (Test 2) | 1x | 1.4x | 1.8x | 2.8x | 8.4x | >16.8x | >20.4x |

In some instances, the SCC time to failure is greater than 1.3× (i.e., 1.3 times) as compared to Reference Alloy 1 under the same temper conditions. In some instances, the SCC time to failure is greater than 1.3× as compared to Reference Alloy 1 under the same temper conditions. In some instances, the SCC time to failure is greater than 1.3× as compared to Reference Alloy 1 under the same temper conditions. In some instances, the SCC time to failure is greater than 1.3× as compared to Reference Alloy 1 under the same temper conditions. In some instances, the SCC time to failure is greater than 1.4× as compared to Reference Alloy 1 under the same temper conditions. In some instances, the SCC time to failure is greater than 1.5× as compared to Reference Alloy 1 under the same temper conditions. In some instances, the SCC time to failure is greater than 2× as compared to Reference Alloy 1 under the same temper conditions. In some instances, the SCC time to failure is greater than 5× as compared to Reference Alloy 1 under the same temper conditions. In some instances, the SCC time to failure is greater than 15× as compared to Reference Alloy 1 under the same temper conditions. In various aspects, the yield strength does not reduce by more than 10% from Reference Alloy 1.

Table 1B depicts the average time to failure (in days) of Alloys 1-4 compared to Reference Alloy 1 under peak aging and over-aging conditions. The SCC time to failure was substantially greater than that of SCC time to failure of Reference Alloy 1.

TABLE 1B

| | | Reference Alloy 1 | Alloy 1 | | Alloy 2 | | Alloy 3 | Alloy 4 |
|---|---|---|---|---|---|---|---|---|
| | Temper Conditions | T6 | T6 | A76 | T6 | A76 | T6 | T6 |
| SCC G30/G44 | Average days to failure | 3.3 | 13 | >19 | >23 | >24 | 19.7 | >20* |

In some instances, the SCC time to failure was at least 12 days when tested under G30/G44 ASTM Standards. In some instances, the SCC time to failure was at least 18 days when tested under the G30/G44 ASTM Standards. In some instances, the SCC time to failure was at least 20 days when tested under G30/G44 ASTM Standards. When subject to over-aging conditions, in some instances the SCC time to failure was at least 19 days, or alternatively, at least 24 days, when tested under G30/G44 ASTM Standards.

Extrusion Properties

In other aspects, the alloys can be extruded over an extrusion temperature range that maintains the temperature and allows the disclosed alloy to be press quenchable. Higher strength alloys (such as 7000 series alloys) are extruded under higher pressure. As described herein, during extrusion the alloy temperature is kept below the Scheil temperature and above the solvus temperature. The cooler the alloy, the higher the extrusion pressure is to extrude the alloy. As such, increasing the temperature of the alloy, while keeping the alloy below the Scheil temperature, provides for improved extrusion during processing. Further, the larger the temperature window bordered by the Scheil and solvus temperatures, the more flexible extrusion processing can be. Some adiabatic heating occurs during extrusion, however, the resulting temperature increase can be accounted for and controlled.

In various aspects, the alloys increase in SCC resistance as compared to Reference Alloys 1 and 2, while maintaining extrudability. Further, the alloys disclosed herein are press quenchable, and do not require and additional heating step after extrusion. The alloys are at a sufficient temperature such that particles remain in solution without a separate heat treatment.

Scheil Temperature

In another aspect, the alloys have Scheil temperatures that do not vary substantially from those of Reference Alloy 1. The Scheil temperature corresponds to the alloy melting temperature. During alloy extrusion, the alloys are heated to as high of a temperature as possible, while remaining below the Scheil temperature. The disclosed alloys have increased Scheil temperatures as compared to other 7xxx series aluminum alloys, thereby allowing homogenization at higher temperatures.

TABLE 2

| | Reference Alloy 1 | Alloy 1 | Alloy 2 | Alloy 5 | Alloy 6 |
|---|---|---|---|---|---|
| Scheil Temperature | 579° C. | 564° C. | 588° C. | 539° C. | 544° C. |

Table 2 describes the measured Scheil temperatures of four representative alloys. In some variations, the Scheil temperature of the alloy is greater than 540° C. In some variations, the Scheil temperature of the alloy is greater than 560° C. In further variations, the Scheil temperature of the alloy is greater than 580° C.

In various aspects, the alloys have a Scheil temperature more than 20° C. lower than that of Reference Alloys 1 and 2. In various aspects, the alloys have a Scheil temperature more than 30° C. lower than that of Reference Alloys 1 and 2. In various aspects, the alloys have a Scheil temperature more than 40° C. lower than that of Reference Alloys 1 and 2. In various aspects, the alloys have a Scheil temperature more than 50° C. lower than that of Reference Alloys 1 and 2. In various aspects, the alloys have a Scheil temperature more than 60° C. lower than that of Reference Alloys 1 and 2.

Solvus Temperature

Solvus temperature is the temperature at which strengthening particles $Mg_xZn_y$ (e.g. $Mg_2Zn$) precipitate. Strengthening particles remain in solution the alloy is extruded. During aging, particles precipitate out of solution. Using an alloy with a low solvus temperature increases the extrusion temperature window.

TABLE 3

| Reference alloy | Alloy 1 | Alloy 2 | Alloy 7 | Alloy 8 | Alloy 5 | Alloy 6 |
|---|---|---|---|---|---|---|
| 338° C. | 355° C. | 343° C. | 344° C. | 348° C. | 338° C. | 338° C. |

Table 3 describes the predicted solvus temperatures of six representative alloys. In some variations, the solvus temperature of the alloy is less than 360° C. In some variations, the solvus temperature of the alloy is less than 350° C. In some variations, the solvus temperature of the alloy is less than 345° C. In some variations, the solvus temperature of the alloy is less than 340° C.

In various aspects, the alloys do have a Solvus temperature more than 10° C. higher than that of Reference Alloys 1 and 2. In various aspects, the alloys do have a Solvus temperature more than 15° C. higher than that of Reference Alloys 1 and 2. In various aspects, the alloys do have a Solvus temperature more than 20° C. higher than that of Reference Alloys 1 and 2. In various aspects, the alloys do have a Solvus temperature more than 25° C. higher than that of Reference Alloys 1 and 2.

TABLE 4

| | Alloy 1 | Alloy 2 |
|---|---|---|
| Extrusion Pressure | 128 MPa +/− 22% | 123 MPa +/− 17% |

In various embodiments, the extrusion pressure of the alloys is less than 250 MPa. It will be recognized that for some alloys, the extrusion pressure is below 150 MPa. As such, the alloys disclosed herein have increased extrusion temperature range at an easily-achieved extrusion pressure.

TABLE 5

| Property | | Reference Alloy 1 | Alloy 1 | | Alloy 2 | | Alloy 3 | Alloy 4 |
|---|---|---|---|---|---|---|---|---|
| | | T6 | T6 | A76 | T6 | A76 | T6 | A76 |
| Typical Hardness (HV) | | 133 | 149 | 139 | 135 | 132 | 124 | 126 |
| Tensile (Longitudinal) | Ultimate Tensile Strength (UTS) (MPa) | 390 | 431 | 396 | 391 | 386 | 368 | 370 |
| | Yield Strength (YS) (MPa) | 354 | 399 | 354 | 351 | 346 | 326 | 330 |
| | % El | 13 | 14 | 16 | 16 | 15 | 18 | 19 |
| | % RA | 37 | 51 | 60 | 64 | 67 | 46 | 44 |

TABLE 5-continued

| Property | | Reference Alloy 1 | Alloy 1 | | Alloy 2 | | Alloy 3 | Alloy 4 |
|---|---|---|---|---|---|---|---|---|
| | | T6 | T6 | A76 | T6 | A76 | T6 | A76 |
| Tensile (Transverse) | UTS (MPa) | 379 | 424 | 392 | 379 | 373 | — | — |
| | YS (MPa) | 344 | 389 | 338 | 337 | 327 | — | — |
| | % El | 15 | 16 | 18 | 17 | 18 | — | — |
| | % RA | 32 | 45 | 54 | 53 | 59 | — | — |
| Charpy Impact Energy ($J/cm^2$) | L-T | 8.0 | 13.3 | 20.5 | 24.2 | 25.4 | 22.4 | 17.9 |
| | T-L | 6.3 | 8.6 | 18.6 | 19.1 | 21.7 | 14.1 | 13.5 |
| | L-S | 3.9 | 5.6 | 7.5 | 7.7 | 9.8 | 10.8 | 8.8 |
| | T-S | 3.2 | 5.4 | 7.5 | 7.7 | 8.1 | 8.7 | 8.9 |
| Electrical conductivity (% IACS) | | 46.1 | 42.1 | 42.5 | 43.1 | 43.3 | 44.3 | 45.1 |

TABLE 6

| | | Alloy | | | | | | | |
|---|---|---|---|---|---|---|---|---|---|
| | | Alloy 9 | | Alloy 10 | | Reference Alloy 2 | | Reference Alloy 1 | |
| Temper | | T6 | A76 | T6 | A76 | T6 | T76 | T6 | A76 |
| Typical Hardness (HV) | | 142 | 124 | 130 | 120 | 130 | 115 | 130 | 115 |
| Tensile (Longitudinal) | UTS (MPa) | 419 | 390 | 382 | 362 | 374 | 357 | 377 | 344 |
| | YS (MPa) | 387 | 349 | 342 | 318 | 345 | 323 | 354 | 311 |
| | % El | 15 | 14 | 16 | 16 | 17 | 16 | 15 | 17 |
| | % RA | 45 | 48 | 50 | 45 | 47 | 48 | 36 | 48 |
| Charpy Impact Energy ($J/cm^2$) | L-T | 14.0 | 11.3 | 22.5 | 15.9 | 14.3 | 19.1 | 9.0 | 10.9 |
| | T-L | 11.8 | 9.2 | 14.5 | 11.0 | 13.0 | 17.5 | 7.3 | 8.9 |
| | L-S | 6.1 | 5.3 | 7.9 | 7.4 | 6.1 | 8.2 | 4.8 | 5.2 |
| | T-S | 6.5 | 4.0 | 6.7 | 5.8 | 5.9 | 8.3 | 4.6 | 4.4 |
| Electrical conductivity (% IACS) | | 42 | 44 | 44 | 45 | 46 | 48 | 46 | 48 |
| SCC G30/G44 (U-bend Test) - RD2 | Average days to failure | 16 | >30 | >22 | >30 | >13 | >25 | 3 | 22 |

Table 5 describes several properties of Alloys 1-4. Alloys 1 and 2 were tested after peak aging treatment (T6) and over-aging treatment (A76). Alloy 3 was tested after peak aging treatment (T6). Alloy 4 was tested after over-aging treatment (A76).

Likewise, Table 6 describes several properties of Alloys 9 and 10. Alloys 9 and 10 were tested after peak aging treatment (T6) and over-aging treatment (A76). They can be compared to Reference Alloy 2, after peak aging treatment (T6), and Reference Alloy 1, tested after both peak aging treatment (T6) and over-aging treatment (A76).

Hardness

In the alloys described herein, the typical hardness of the alloys described herein is not less than 10% of the hardness of Reference Alloy 1 and Reference Alloy 2 having the same aging treatment (temper). In some variations, the typical hardness of the alloys described herein is not less than 5% of the hardness of Reference Alloy 1 and Reference Alloy 2 having the same aging treatment. In some variations, the typical hardness of the alloys described herein is greater than the hardness of Reference Alloy 1 and Reference Alloy 2 having the same aging treatment. In particular, Table 5 shows that the typical hardness of Alloy 1 and 2 is greater than that of Reference Alloy 1 under T6 aging conditions. The typical hardness of Alloys 3 and 4 is less than 10% lower than the hardness of Reference Alloy 1. Table 6 shows the hardness of both Alloys 9 and 10 is equal to or greater than the hardness of both Reference Alloys 1 and 2 under T6 aging conditions, and greater than or equal to Reference Alloy 1 under A76 aging conditions.

Ultimate Tensile Strength

In the alloys described herein, the longitudinal and transverse ultimate tensile strength is not less than 10% of the respective longitudinal and transverse ultimate tensile strength of Reference Alloy 1 and Reference Alloy 2 having the same aging treatment. In some variations, the longitudinal and transverse ultimate tensile strength is not less than 5% of the respective longitudinal and transverse ultimate tensile strength of Reference Alloy 1 and Reference Alloy 2 having the same aging treatment. In some variations, the longitudinal and transverse ultimate tensile strength is greater than the respective longitudinal and transverse ultimate tensile strength of Reference Alloy 1 and Reference Alloy 2 having the same aging treatment.

Table 5 shows that the ultimate tensile strength of Alloys 1 and 2 in both the longitudinal and transverse direction is greater than that of Reference Alloy 1 under T6 aging conditions. Alloys 3 and 4 have an ultimate tensile strength of not more than 10% of Reference Alloy 1 in the longitudinal direction. Table 6 shows the ultimate tensile strength of both Alloys 9 and 10 is greater than the ultimate tensile strength of both Reference Alloys 1 and 2 under the same aging conditions.

Longitudinal ultimate tensile strength and yield strength of peak aged Alloy 1 were higher than those of Reference Alloy 1. The ultimate tensile strength and yield strength of peak aged Alloy 2 were approximately equal to those of Reference Alloy 1.

Yield Strength

Yield strengths of the alloys may be determined via ASTM E8, which covers the testing apparatus, test specimens, and testing procedure for tensile testing.

In the alloys described herein, the longitudinal and transverse yield strength is not less than 10% of the respective longitudinal and transverse yield strength of Reference Alloy 1 and Reference Alloy 2 having the same aging treatment. In some variations, the longitudinal and transverse yield strength is not less than 5% of the respective longitudinal and transverse yield strength of Reference Alloy 1 and Reference Alloy 2 having the same aging treatment. In some variations, the longitudinal and transverse yield strength is greater than the respective longitudinal and transverse yield strength of Reference Alloy 1 and Reference Alloy 2 having the same aging treatment.

Table 5 shows that the yield strength of Alloy 1 and 2 in both the longitudinal and transverse direction is greater than that of Reference Alloy 1 under T6 aging conditions. Alloys 3 and 4 have a yield strength of not more than 10% of Reference Alloy 1. Table 6 shows the yield strength of Alloy 9 is greater than those of both Reference Alloys 1 and 2 under the same aging conditions. The yield strength of Alloy 10 is not less than 5% lower than the yield strength of both Reference Alloys 1 and 2.

Ductility

The ductility of the alloys described herein is greater than those of reference alloys. As depicted in Table 5, the ductility of peak aged Alloys 1 and 2, as measured by both percent elongation (% El) and percent reduction in area (% RA), were higher than those of peak aged Reference Alloy 1. As such, the alloys have improved ductility as compared to the Reference Alloys. In some instances, the percent elongation of the alloy is at least 14%. In some instances, the percent elongation of the alloy is at least 15%. In some instances, the percent elongation of the alloy is at least 16%. In some instances, the percent elongation of the alloy is at least 17%. In some instances, the percent elongation of the alloy is at least 18%. In some instances, the percent elongation of the alloy is at least 19%. In some instances, the percent reduction in area of the alloy is at least 40%.

In some instances, the percent reduction in area of the alloy is at least 43%. In some instances, the percent reduction in area of the alloy is at least 50%. In some instances, the percent reduction in area of the alloy is at least 60%. In some instances, the percent reduction in area of the alloy is at least 64%.

Toughness

In further aspects, the toughness of the peak aged alloys increased over that of Reference Alloy 1 in several orientations. As depicted in Table 5, Alloys 1-4 showed an improved Charpy impact energy over that of Reference Alloy 1. In each of the L-T, T-L, L-S, and T-S orientations, each of Alloys 1-4 absorbed more impact energy per square unit area than Reference Alloy 1. This observed effect held for each orientation for each of Alloys 1-4, and for peak aged (T6) and over-aged (A76) alloys.

Likewise, as depicted in Table 6, Alloys 9 and 10 absorbed more impact energy per square unit area than Reference Alloy 1 in each of the L-T, T-L, L-S, and T-S orientations. This observed effect held for each orientation for each of Alloys 9 and 10, and for peak aged (T6) and over-aged (A76) alloys. In some aspects, the Charpy reference energy in the L-T orientation is not less than 10% of that of Reference Alloy 1 and Reference Alloy 2.

In various aspects, the Charpy reference energy in the L-T orientation is greater than or equal to 10 J/cm$^2$ under A76 temper conditions. In various aspects, the Charpy reference energy in the L-T orientation is greater than or equal to 12 J/cm$^2$ under T6 temper conditions.

Figure 3:
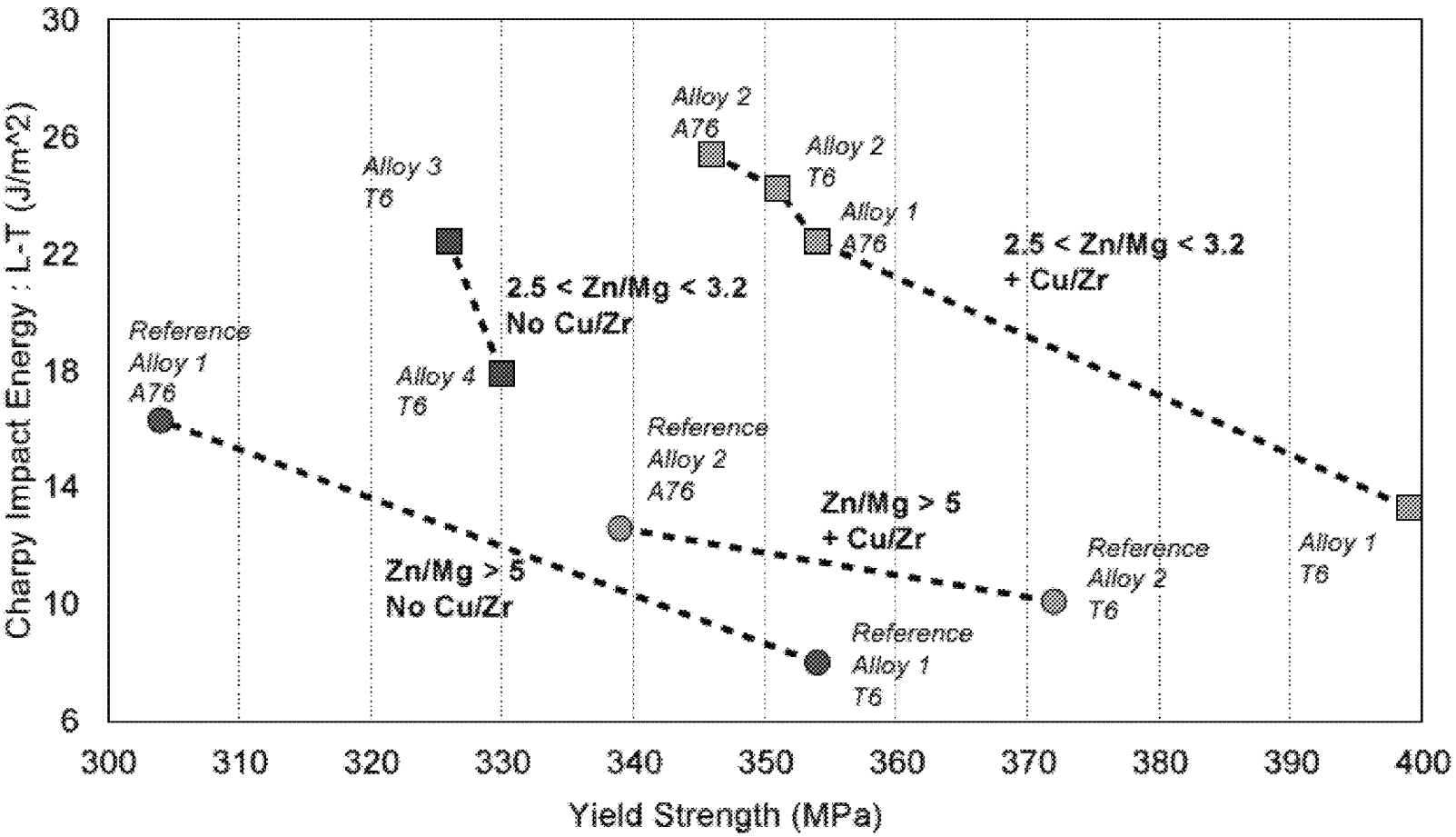
FIG. 3 depicts the Charpy impact energy as a function of yield strength for different ratios of Zn:Mg with and without Cu and Zr of representative alloys.

FIG. 3 depicts the relationship between Charpy Impact Energy and yield strength of certain representative alloys as compared to reference alloys. Alloys in which 2.5<Zn:Mg<3.2 were compared to alloys in which Zn:Mg>5.0, with and without Cu. The Charpy Impact Energy was higher for alloys in the lower ratio of Zn:Mg, while yield strength remained comparable. Alloys in which 2.5<Zn:Mg<3.2 with Cu and Zr (Alloys 1 and 2) and without Cu and Zr (Alloys 3 and 4) have substantially higher Charpy Impact Energy than alloys having a Zn:Mg ratio above 5.

Corrosion Resistance

Figure 4:
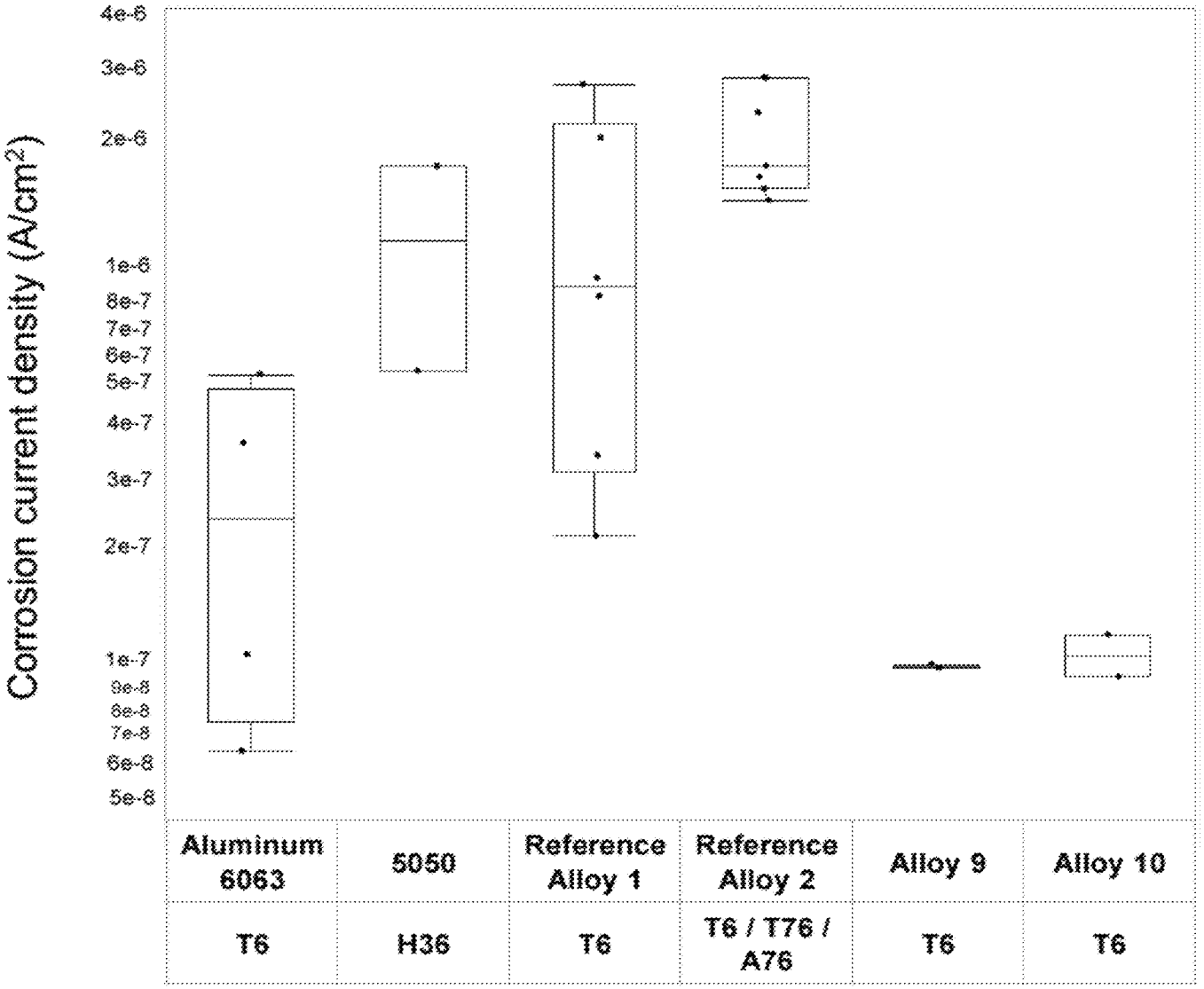
FIG. 4 depicts the corrosion current density for Alloys 9 and 10 as compared to Reference Alloys 1 and 2, as well as alloys 6063 and 5050.

Alloys 9 and 10 exhibited a lower corrosion current density than both Reference Alloys 1 and 2. FIG. 4 depicts the corrosion current density on a logarithmic scale for a series of aluminum alloys. Using bare aluminum plaques (not anodized) and an electrolyte with 3.5 wt % NaCl at neutral pH, all potentials with respect to a saturate calomel electrode (SCE). The corrosion current density of Alloys 9 and 10 was lower than each of Reference Alloys 1 and 2. The lower corrosion current density of Alloys 9 and 10 corresponds to improved corrosion resistance.

Figure 5:
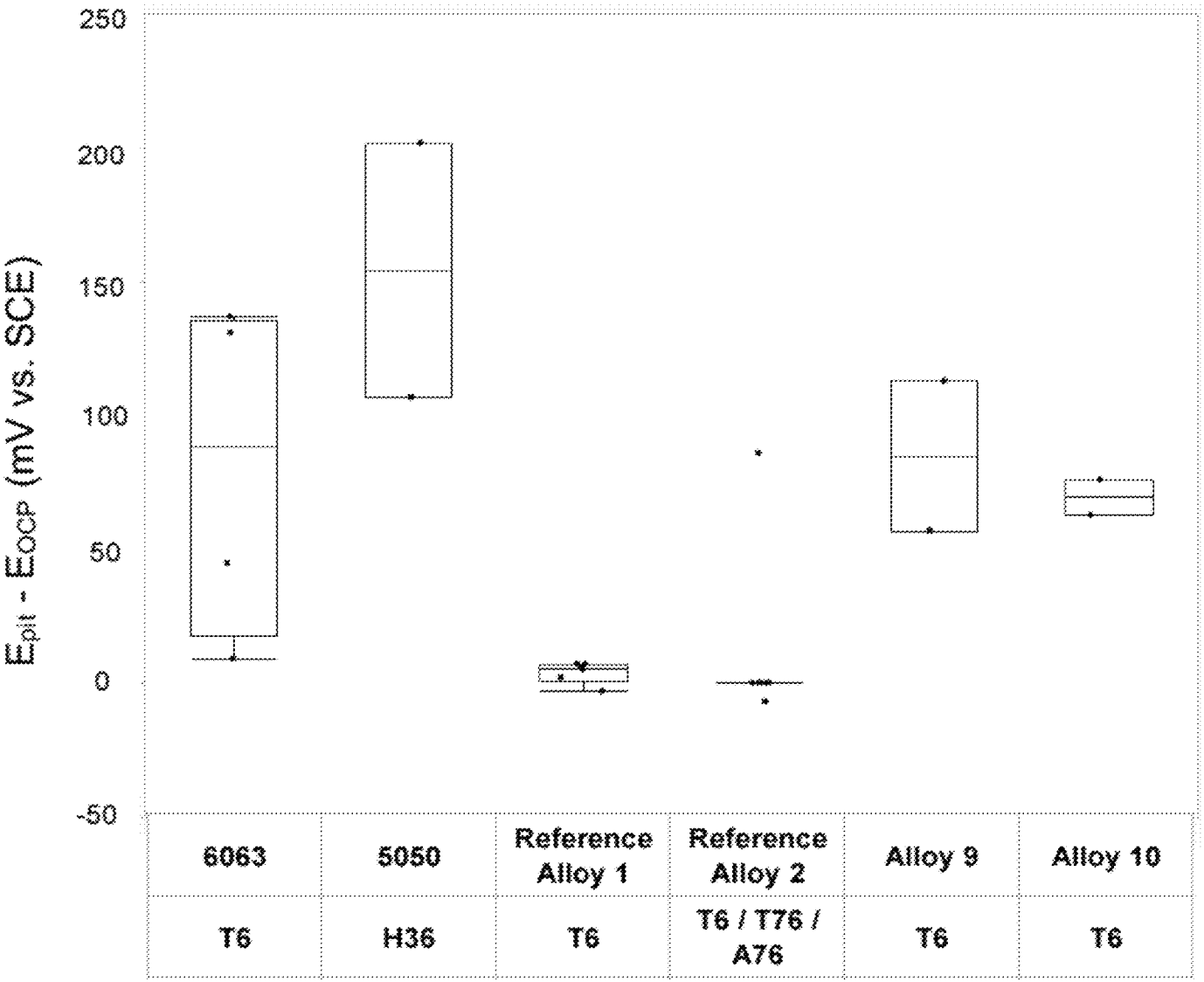
FIG. 5 depicts the threshold passivity as depicted by the difference of critical pitting potential and open circuit potential (Epit-Eocp) for Alloys 9 and 10 as compared to Reference Alloys 1 and 2, as well as alloys 6063 and 5050.

Likewise, Alloys 9 and 10 have a higher critical potential for pitting. FIG. 5 depicts the difference of critical pitting potential and open circuit potential (Epit-Eocp) for Alloys 9 and 10. The increased potential difference corresponds to improved corrosion resistance as compared to Reference Alloy 1 and 2.

Copper

Most sample alloys show neutral color. The neutral color may result from limiting the presence of Cu in the alloys.

In some aspects, the alloys do not have so much copper that they exhibit yellowish color. The alloy is thereby more cosmetically appealing by having a neutral color after anodizing.

The presence of Cu in 7xxx Al alloys can increase yield strength of alloys, but can also have a deleterious effect on cosmetic appeal. Without wishing to be limited to a particular mechanism or mode of action, Cu may provide stability to $Mg_xZn_y$ particles.

In some variations, the alloys include Cu from 0 to 0.01 wt % Cu. In further variations, the alloys include Cu from 0.025 wt % to 0.055 wt % Cu. In further variations, the alloys include 0.040 wt % to 0.050 wt % Cu. In some variations, the alloys include 0.040 wt % Cu. In some variations, the alloys include 0.050 wt % Cu. The presence of Cu provides for increased yield strength without loss of neutral color on the L* a* b* scale, as described in details later. Without wishing to be limited to any theory or mode of action, the presence of Cu in the alloys of the disclosure provides increased stability $Mg_xZn_y$.

Zirconium

Conventional 7xxx series aluminum alloys can include Zr to increase the hardness of the alloy. The presence of Zr in conventional 7xxx series alloys produces a fibrous grain structure in the alloy, and allows the alloy to be reheated without expanding the grain structure of the alloy. In the alloys disclosed herein, the reduction in or absence of Zr allows surprising grain structure control at a low average grain aspect ratio from sample-to-sample. In addition, reduction or elimination of Zr in the alloy can reduce elongated grain structures and/or streaky lines in finished products.

Without wishing to be held to a particular mechanism or mode of action, in some variations, Zr additions to the alloys can inhibit recrystallization and produce a long grain structure that can lead to undesirable anodized cosmetics. Absence of Zr in the alloys can help form equiaxed grains.

In some embodiments, the alloy can have 0.03-0.06 wt % Zr. In some embodiments, the alloy can have 0.04-0.05 wt % Zr. In some embodiments, the alloy can have from 0.04-0.06 wt % Zr. In some embodiments, the alloy can have from 0.03-0.05 wt % Zr. In still further embodiments the alloy can have about 0.04 wt % Zr. In further embodiments, the alloy can have about 0.05 wt % Zr.

In some embodiments, the alloys include Zr from 0 to 0.01 wt %. In some embodiments, the alloys include Zr less than 0.001 wt %. In some embodiments, the alloys include Zr greater than 0 wt %.

Iron

In various aspects, the wt % of Fe in the alloys described herein can be lower than that for conventional 7xxx series aluminum alloys. By controlling the Fe level to be at the disclosed quantities, the alloys can appear less dark, i.e. have a lighter color, after anodization treatment, and possess fewer coarse particle defects. The reduction in Fe can reduce the volume fraction of course particles, which can improve cosmetic qualities such as distinctness of image ("DOI") and Haze after anodization, as described herein.

The alloys also can have lower impurity levels of Fe than commercial 7000 series aluminum alloys. Without wishing to be held to a particular mechanism or mode of action, the reduced Fe content in the alloys can help reduce the number of coarse secondary particles that may compromise the cosmetic appearance, both before and after anodizing. In contrast, commercial alloys have higher impurity of Fe than the alloys of the disclosure. The resulting DOI and Log Haze can be substantially improved in the alloys described herein.

The wt % of Fe can help the alloy maintain a fine grain structure. Alloys with a small trace of Fe can also have a neutral color after anodizing. In some variations, the alloy has from 0.06 wt %-0.08 wt % Fe. In some variations, the alloy has no greater than 0.08 wt % Fe.

In various disclosed alloys, reduced or eliminated Zr combined with low wt % Fe allow for grain size control.

Silicon

The reduction in Si can reduce the volume fraction of course particles, which can improve cosmetic qualities such as distinctness of image ("DOI") and Haze after anodization, as described herein.

In various aspects, the alloys disclosed herein can include Si less than 0.05 wt %. In some embodiments, the alloys include Si less than 0.04 wt %. In some embodiments, the alloys include Si greater than 0.03 wt %. In some embodiments, the alloys include Si greater than 0.04 wt %.

In various additional embodiments, additionally elements can be added to the alloy in amounts that do not exceed 0.050 wt % per element. Examples of such elements include one or more of Ca, Sr, Sc, Y, La, Ni, Ta, Mo, W, and Co. Additional elements that do not exceed 0.050 wt % per element, or alternatively 0.10 wt % per element, include Li, Cr, Ti, Mn, Ni, Ge, Sn, In, V, Ga, and Hf.

Grain Size

In the alloys disclosed herein, the reduction in or absence of Zr allows surprising grain structure control at a low average grain aspect ratio from sample-to-sample. In addition, reduction or elimination of Zr in the alloy can reduce elongated grain structures and/or streaky lines in finished products.

Grains have aspect ratios outside the range of various alloys disclosed herein (e.g. between 1.0:0.80 and 1.0:1.2). Further, the resulting alloys can have deficits in yield strength, hardness, and/or cosmetics.

In some instances, the wt % concentrations of Zr and Fe in the alloys disclosed herein provide for control of grain structure. In conventional 7xxx series Al alloys, grain size can increase during heat treatment after extrusion. In conventional 7xxx alloys with larger Zr concentrations, grain inflation can produce grains that are more fibrous and visible, producing incongruities that are cosmetically unacceptable. In various disclosed alloys, reduced or eliminated Zr combined with low wt % Fe allow for grain size control.

The wt % concentrations of Zr and Fe in the alloys disclosed herein provide for control of grain structure. In conventional 7xxx series Al alloys, grain size can increase during heat treatment after extrusion. In conventional 7xxx alloys with larger Zr concentrations, grain inflation can produce grains that are more fibrous and visible, producing incongruities that are cosmetically unacceptable. Such grains have aspect ratios outside the range of various alloys disclosed herein (e.g. between 1.0:0.80 and 1.0:1.2). Further, the resulting alloys can have deficits in yield strength, hardness, and/or cosmetics. In the presently disclosed alloys, reduced or eliminated Zr combined with low wt % Fe can allow for grain size control.

Cosmetics

The disclosed alloys provide improved lightness and clarity in combination with increased yield strength and hardness over conventional alloys. In conventional Al alloys, high wt % Fe and/or Si can result in poor anodization and cosmetics. In the alloys disclosed herein, low Fe and Si result in fewer inclusions that disrupt clarity following anodization. As a result, the alloys described herein have improved clarity.

Standard methods may be used for the evaluation of cosmetics including color, gloss and haze. Gloss describes the perception of a surface appearing "shiny" when light is reflected. The Gloss Unit (GU) is defined in international standards including ISO 2813 and ASTM D523. It is determined by the amount of reflected light from a highly polished black glass standard of known refractive index of 1.567. The standard is assigned with a specular gloss value of 100. Haze describes the milky halo or bloom seen on the surface of high gloss surfaces. Haze is calculated using the angular tolerances described in ASTM E430. The instrument can display the natural haze value (HU) or Log Haze Value ($HU_{LOG}$). A high gloss surface with zero haze has a deep reflection image with high contrast. DOI (Distinctness Of Image) is, as the name implies, a function of the sharpness of a reflected image in a coating surface, based on ASTM D5767. Orange peel, texture, flow out, and other parameters can be assessed in coating applications where high gloss quality is becoming increasingly important. The measurements of gloss, haze, and DOI may be performed by testing equipment, such as Rhopoint IQ.

By using the aluminum alloys of the present disclosure, defects viewed through the anodized layer were reduced, while maintaining yield strength and hardness, thereby providing a high gloss and high distinctness of image with surprisingly low haze.

Thermal Conductivity

High yield strength may also trade off with lower thermal conductivity for the Al alloys described herein. Generally, Al alloys have lower thermal conductivity than pure Al. Alloys with higher alloying contents for more strengthening may have lower thermal conductivity than alloys with reduced alloying contents for less strengthening. The alloys can have a thermal conductivity of at least 130 W/mK, which can help heat dissipation of the electronic devices. For example, the 7xxx series alloys described herein may have a thermal conductivity greater than 130 W/mK. In some embodiments, the modified 7xxx alloy may have a thermal conductivity greater than or equal to 140 W/mK. In some embodiments, the modified 7xxx alloy may have a thermal conductivity greater than or equal to 150 W/mK. In some embodiments, the modified 7xxx alloy may have a thermal conductivity greater than or equal to 160 W/mK. In some embodiments, the modified 7xxx alloy may have a thermal conductivity greater than or equal to 170 W/mK. In some embodiments, the modified 7xxx alloy may have a thermal conductivity greater than or equal to 180 W/mK. In some embodiments, the modified 7xxx alloy may have a thermal conductivity less than 140 W/mK. In various embodiments, the alloy may have a thermal conductivity of 190-200 W/mK. The alloys may have a thermal conductivity of about 130-200 W/mK. In various embodiments, the alloy may have a thermal conductivity of about 150-180 W/mK. For different electronic devices, the designed thermal conductivity and the designed yield strength may vary, depending on the type of device, such as handheld devices, portable devices, or desktop devices.

Grain Aspect Ratio

In various aspects, the alloys have equiaxed grains. Longer non-equiaxed grains tend to have higher SCC resistances. As such, the combination of equiaxed grains and high SCC resistance as described herein provides an unexpected benefit.

In some aspects, the alloy has an average grain aspect ratio less than or equal to 1:1.3. In some aspects, the alloy has an average grain aspect ratio less than or equal to 1:1.2. In some aspects, the alloy has an average grain aspect ratio less than or equal to 1:1.1. In some aspects, the alloy has an average grain aspect ratio less than or equal to 1:1.05. In some aspects, the alloy has an average grain aspect ratio less than or equal to 1:1.04. In some aspects, the alloy has an average grain aspect ratio less than or equal to 1:1.03. In some aspects, the alloy has an average grain aspect ratio less than or equal to 1:1.02. In some aspects, the alloy has an average grain aspect ratio less than or equal to 1:1.01. In some aspects, the alloy has an average grain aspect ratio equal to 1:1.

In some aspects, the alloy has an average grain aspect ratio at least 0.8:1. In some aspects, the alloy has an average grain aspect ratio at least 0.9:1. In some aspects, the alloy has an average grain aspect ratio at least 0.95:1. In some aspects, the alloy has an average grain aspect ratio at least 0.96:1. In some aspects, the alloy has an average grain aspect ratio at least 0.97:1. In some aspects, the alloy has an average grain aspect ratio at least 0.98:1. In some aspects, the alloy has an average grain aspect ratio at least 0.99:1.

Processing

In some embodiments, a melt for an alloy can be prepared by heating the alloy, including the composition. After the melt is cooled to room temperature, the alloys may be subjected to various heat treatments, such homogenization, extruding, forging, aging, and/or other forming or solution heat treatment techniques.

The $Mg_xZn_y$ phase in the alloys described herein may be both within the grains and at the grain boundary. The $Mg_xZn_y$ phase may constitute about 3 vol % to about 6 vol % of the alloys. $Mg_xZn_y$ may be formed as discrete particles and/or linked particles. Various heat treatments can be used to guide the formation of $Mg_xZn_y$ as discrete particles, rather than linked particles. In various aspects, discrete particles can result in better strengthening than linked particles.

In some embodiments, the cooled alloy can be homogenized by heating to an elevated temperature, such as 500° C., and held at the elevated temperature for a period of time, such as for about 8 hours. It will be appreciated by those skilled in the art that the heat treatment conditions (e.g. temperature and time) may vary. Homogenization refers to a process in which high-temperature soaking is used at an elevated temperature for a period of time. Homogenization can reduce chemical or metallurgical segregation, which may occur as a natural result of solidification in some alloys. In some embodiments, the high-temperature soaking is conducted for a dwell time, e.g. from about 4 hours to about 48 hours. It will be appreciated by those skilled in the art that the heat treatment condition (e.g. temperature and time) may vary.

In some embodiments, the homogenized alloy can be hot-worked, e.g., extruded. Extrusion is a process for converting a metal ingot or billet into lengths of uniform cross section by forcing the metal to flow plastically through a die orifice.

In some embodiments, the hot-worked alloys can be solution heat-treated at elevated temperatures above 450° C. for a period of time, e.g. 2 hours. The solution heat treatments can alter the strength of the alloy.

After the solution-heat treatment, the alloy can be aged at a first temperature and time, e.g. 100° C. for about 5 hours, then heated to a second temperature for a second period of time, e.g. 150° C. for about 9 hours, and then quenched with water. Aging (or tempering) is a heat treatment at an elevated temperature, and may induce a precipitation reaction to form $Mg_xZn_y$ precipitates. In some embodiments, aging may be conducted at a first temperature for a first period of time and followed at a second temperature for a second period of time. Single temperature heat treatments may also be used, for example, at 120° C. for 24 hours. It will be appreciated by those skilled in the art that the heat treatment condition (e.g. temperature and time) may vary.

In further embodiments, the alloy may be optionally subjected to a stress-relief treatment between the solution heat-treatment and the aging heat-treatment. The stress-relief treatment can include stretching the alloy, compressing the alloy, or combinations thereof.

Anodizing and Blasting

In some embodiments, the alloys can be anodized. Anodizing is a surface treatment process for metal, most commonly used to protect aluminum alloys. Anodizing uses electrolytic passivation to increase the thickness of the natural oxide layer on the surface of metal parts. Anodizing may increase corrosion resistance and wear resistance, and may also provide better adhesion for paint primers and glues than bare metal. Anodized films may also be used for cosmetic effects, for example, it may add interference effects to reflected light.

The alloys described herein can be anodized using solely sulfuric acid at 20° C. and 1.5 ASD.

Without wishing to be held to a particular mechanism or mode of action, reducing free Zn can reduce anodization delamination. Alternatively, in various embodiments, some excess Zn or Mg may be present.

In some embodiments, the alloys can form enclosures for the electronic devices. The enclosures may be designed to have a blasted surface finish, or an absence of streaky lines.

Blasting is a surface finishing process, for example, smoothing a rough surface or roughening a smooth surface. Blasting may remove surface materials by forcibly propelling a stream of abrasive material against a surface under high pressure.

Color

Standard methods may be used for evaluation of cosmetics including color, gloss, and haze. The color of objects may be determined by the wavelength of light that is reflected or transmitted without being absorbed, assuming incident light is white light. The visual appearance of objects may vary with light reflection or transmission. Additional appearance attributes may be based on the directional brightness distribution of reflected light or transmitted light, commonly referred to glossy, shiny, dull, clear, haze, among others. The quantitative evaluation may be performed based on ASTM Standards on Color & Appearance Measurement or ASTM E-430 Standard Test Methods for Measurement of Gloss of High-Gloss Surfaces, including ASTM D523 (Gloss), ASTM D2457 (Gloss on plastics), ASTM E430 (Gloss on high-gloss surfaces, haze), and ASTM D5767 (DOI), among others. The measurements of gloss, haze, and DOI may be performed by testing equipment, such as Rhopoint 10.

In some embodiments, color may be quantified by parameters L*, a*, and b*, where L* stands for light brightness, a* stands for color between red and green, and b* stands for color between blue and yellow. For example, high b* values suggest an unappealing yellowish color, not a gold yellow color. Values near zero in a* and b* suggest a neutral color. Low L* values suggest dark brightness, while high L* value suggests great brightness. For color measurement, testing equipment, such as X-Rite Color i7 XTH, X-Rite Coloreye 7000 may be used. These measurements are according to CIE/ISO standards for illuminants, observers, and the L* a* b* color scale. For example, the standards include: (a) ISO 11664-1:2007(E)/CIE S 014-1/E:2006: Joint ISO/CIE Standard: Colorimetry—Part 1: CIE Standard Colorimetric Observers; (b) ISO 11664-2:2007(E)/CIE S 014-2/E:2006: Joint ISO/CIE Standard: Colorimetry—Part 2: CIE Standard Illuminants for Colorimetry, (c) ISO 11664-3:2012(E)/CIE S 014-3/E:2011: Joint ISO/CIE Standard: Colorimetry—Part 3: CIE Tristimulus Values; and (d) ISO 11664-4:2008 (E)/CIE S 014-4/E:2007: Joint ISO/CIE Standard: Colorimetry—Part 4: CIE 1976 L* a* b* Colour Space.

As described herein, reducing or eliminating Cu from the alloys provides the alloy with neutral color. Alloys have the neutral color and low aspect ratios in the range 0.8-1.2 as described herein. The L*a*b* corresponding neutral color resulting at least in part from the alloy composition described herein is described herein.

In various aspects, the L* of the alloy disclosed herein is at least 85. In some instances, the L* of the alloy is at least 90.

The alloys disclosed herein can have neutral color. Neutral color refers to a* and b* that does not deviate beyond certain values close to 0. In various aspects, a* is not less than −0.5. In various aspects, a* is not less than −0.25. In various aspects, a* is not greater than 0.25. In various aspects, a* is not greater than 0.5. In further aspects, a* is not less than −0.5 and not greater than 0.5. In further aspects, a* is not less than −0.25 and not greater than 0.25.

In various aspects, b* is not less than −2.0. In various aspects, b* is not less than −1.75. In various aspects, b* is not less than −1.50. In various aspects, b* is not less than −1.25. In various aspects, b* is not less than −1.0. In various aspects, b* is not less than −0.5. In various aspects, b* is not less than −0.25. In various aspects, b* is not greater than 1.0. In various aspects, b* is not greater than 1.25. In various aspects, b* is not greater than 1.50. In various aspects, b* is not greater than 1.75. In various aspects, b* is not greater than 2.0. In various aspects, b* is not greater than 0.5. In various aspects, b* is not greater than 0.25. In further aspects, b* is not less than −1.0 and not greater than 1.0. In further aspects, b* is not less than −0.5 and not greater than 0.5.

In various embodiments, the alloys may be used as housings or other parts of an electronic device, such as, for example, a part of the housing or casing of the device. Devices can include any consumer electronic device, such as cell phones, desktop computers, laptop computers, and/or portable music players. The device can be a part of a display, such as a digital display, a monitor, an electronic-book reader, a portable web-browser, and a computer monitor. The device can also be an entertainment device, including a portable DVD player, DVD player, Blue-Ray disk player, video game console, or music player, such as a portable music player. The device can also be a part of a device that provides control, such as controlling the streaming of images, videos, sounds, or it can be a remote control for an electronic device. The alloys can be part of a computer or its accessories, such as the hard driver tower housing or casing, laptop housing, laptop keyboard, laptop track pad, desktop keyboard, mouse, and speaker. The alloys can also be applied to a device such as a watch or a clock.

In various further embodiments, more than one alloy can be used in a device casing. For example, an alloy having increased SCC resistance can be placed on the edges of a casing, while alloy without this difference is in the middle of the casing.

Having described several embodiments, it will be recognized by those skilled in the art that various modifications, alternative constructions, and equivalents may be used without departing from the spirit of the disclosure. Additionally, a number of well-known processes and elements have not been described in order to avoid unnecessarily obscuring the embodiments disclosed herein. Accordingly, the above description should not be taken as limiting the scope of the document.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the method and system, which, as a matter of language, might be said to fall there between.

The invention claimed is:

1. An aluminum alloy comprising:

at least 3.4 wt % Zn;

1.3 to 2.1 wt % Mg;

no greater than 0.06 wt % Cu;

no greater than 0.06 wt % Zr;

0.06 to 0.08 wt % Fe;

no greater than 0.05 wt % Si; and the balance is aluminum and incidental impurities, wherein the alloy has a wt % ratio of Zn to Mg from 2.5 to 3.5.

2. The aluminum alloy according to claim 1, comprising 0.03-0.06 wt % Zr.

3. The aluminum alloy according to claim 1, comprising 0.04-0.05 wt % Zr.

4. The aluminum alloy according to claim 1, comprising less than 0.01 wt % Zr.

5. The aluminum alloy according to claim 1, comprising 0.025-0.06 wt % Cu.

6. The aluminum alloy according to claim 1, comprising 0.04-0.05 wt % Cu.

7. The alloy according to claim 1, comprising:
no greater than 0.02 wt % Mn;
no greater than 0.02 wt % Cr;
no greater than 0.02 wt % Ti;
no greater than 0.02 wt % Ga;
no greater than 0.02 wt % Sn;
no greater than 0.03 wt % total of Mn and Cr;
no greater than 0.02 wt % of any one additional element; and
no greater than 0.10 wt % total of additional elements.

8. The alloy according to claim 1, wherein the stress corrosion cracking of the alloy is greater than 12 days to failure measured according to G30/G44 ASTM standards.

9. The alloy according to claim 1, wherein the alloy comprises equiaxed grains, wherein the alloy has an average grain aspect ratio less than or equal to 1:1.2.

10. The alloy according to claim 1, wherein the Charpy impact energy in the L-T orientation is greater than or equal to 11 $J/cm^2$.

11. The alloy according to claim 1, wherein the alloy has a yield strength of about at least 300 MPa.

12. The alloy according to claim 1, wherein the alloy comprises greater than 0.04 wt % Si.

13. A method for producing an aluminum alloy, the method comprising:
forming a melt that comprises an alloy comprising:
at least 3.4 wt % Zn;
1.3 to 2.1 wt % Mg;
no greater than 0.06 wt % Cu;
no greater than 0.06 wt % Zr;
0.06 to 0.08 wt % Fe;
no greater than 0.05 wt % Si; and
the balance is aluminum and incidental impurities, wherein the alloy has a wt % ratio of Zn to Mg from 2.5 to 3.5;
cooling the melt to room temperature;
homogenizing the cooled alloy by heating to a first elevated temperature;
hot-working the homogenized alloy;
solution treating the hot-worked alloy at a second elevated temperature; and
aging the solution treated alloy at a third elevated temperature for a period of time.

14. The method according to claim 13, wherein the alloy comprises greater than 0.04 wt % Si.

15. The method according to claim 13, comprising:
no greater than 0.02 wt % Mn;
no greater than 0.02 wt % Cr;
no greater than 0.02 wt % Ti;
no greater than 0.02 wt % Ga;
no greater than 0.02 wt % Sn;
no greater than 0.03 wt % total of Mn and Cr;
no greater than 0.02 wt % of any one additional element; and
no greater than 0.10 wt % total of additional elements.

16. The article according to claim 13, comprising:
no greater than 0.02 wt % Mn;
no greater than 0.02 wt % Cr;
no greater than 0.02 wt % Ti;
no greater than 0.02 wt % Ga;
no greater than 0.02 wt % Sn;
no greater than 0.03 wt % total of Mn and Cr;
no greater than 0.02 wt % of any one additional element; and
no greater than 0.10 wt % total of additional elements.

17. The method according to claim 13, wherein the alloy comprises equiaxed grains, wherein the alloy has an average grain aspect ratio less than or equal to 1:1.2.

18. An article comprising the alloy comprising:
at least 3.4 wt % Zn;
1.3 to 2.1 wt % Mg;
no greater than 0.06 wt % Cu;
no greater than 0.06 wt % Zr;
0.06 to 0.08 wt % Fe;
no greater than 0.05 wt % Si; and
the balance is aluminum and incidental impurities, wherein the alloy has a wt % ratio of Zn to Mg from 2.5 to 3.5.

19. The article according to claim 18, wherein the alloy comprises greater than 0.04 wt % Si.

* * * * *